United States Patent [19]

Landis et al.

[11] Patent Number: 4,647,878

[45] Date of Patent: Mar. 3, 1987

[54] COAXIAL SHIELDED DIRECTIONAL MICROWAVE COUPLER

[75] Inventors: Richard C. Landis, Shelton, Conn.; Edward L. Griffin; Inder G. Bahl, both of Roanoke, Va.

[73] Assignee: ITT Corporation, New York, N.Y.

[21] Appl. No.: 671,160

[22] Filed: Nov. 14, 1984

[51] Int. Cl.[4] ..... H01P 5/18

[52] U.S. Cl. ..... 333/115; 333/116; 174/68.5; 29/600; 29/825; 29/829

[58] Field of Search ..... 333/116, 115, 296, 238; 174/68.5; 29/600, 825, 828, 829, 830, 842; 156/150

[56] References Cited

U.S. PATENT DOCUMENTS

| | | | |
|---|---|---|---|
| 2,860,308 | 11/1958 | Bales | 333/116 |
| 2,926,317 | 2/1960 | Blitz | 333/238 |
| 2,995,806 | 8/1961 | Allison et al. | 333/239 X |
| 3,157,847 | 11/1964 | Williams | 29/600 X |
| 3,199,054 | 8/1965 | Holland et al. | 333/163 |
| 3,221,274 | 11/1965 | Vaz | 333/115 |
| 3,225,351 | 12/1965 | Chatelain et al. | 333/238 X |
| 3,243,498 | 3/1966 | Allen et al. | 174/68.5 |
| 3,292,115 | 12/1966 | La Rosa | 333/239 |
| 3,298,724 | 6/1966 | Walsh et al. | 333/238 |
| 3,358,248 | 12/1967 | Saad | 333/115 |
| 3,368,112 | 2/1968 | Hellgren | 333/238 X |
| 3,376,463 | 4/1968 | Feinstein | 315/3.5 |
| 3,398,232 | 8/1968 | Hoffman | 333/238 X |
| 3,416,102 | 12/1968 | Hamlin | 333/115 |
| 3,436,690 | 4/1969 | Golant et al. | 333/156 |
| 3,484,725 | 12/1969 | Sobotka | 333/161 |
| 3,496,492 | 2/1970 | Kürzl et al. | 333/116 |
| 3,504,223 | 3/1970 | Orr et al. | 315/3.5 |
| 3,555,461 | 1/1971 | Ralph et al. | 333/156 |
| 3,613,230 | 10/1971 | Griff | 174/36 X |
| 3,617,952 | 11/1971 | Beech | 333/116 |
| 3,649,274 | 3/1972 | Older et al. | 430/312 |
| 3,666,983 | 5/1972 | Krah et al. | 333/162 X |
| 3,696,433 | 10/1972 | Killion et al. | 333/238 X |
| 3,701,958 | 10/1972 | Jaag | 333/185 |
| 3,768,048 | 10/1973 | Jones, Jr. et al. | 333/238 |
| 3,837,074 | 9/1974 | Griff | 174/36 X |
| 3,900,806 | 8/1975 | Caroli | 333/156 X |
| 3,922,479 | 11/1975 | Older et al. | 174/68.5 |
| 3,924,204 | 12/1975 | Fache et al. | 333/21 R |
| 4,139,827 | 2/1979 | Russell | 333/116 |
| 4,159,222 | 6/1979 | Lebow et al. | 156/632 |
| 4,288,761 | 9/1981 | Hopfer | 333/116 |
| 4,306,925 | 12/1981 | Lebow et al. | 156/150 |
| 4,313,095 | 1/1982 | Jean-Frederic | 333/116 |
| 4,342,143 | 8/1982 | Jennings | 336/200 X |
| 4,367,450 | 1/1983 | Carillo | 336/200 |
| 4,375,053 | 2/1983 | Viola et al. | 333/116 |
| 4,375,054 | 2/1983 | Paris | 333/116 |
| 4,394,630 | 7/1983 | Kenyon | 333/116 |
| 4,439,748 | 3/1984 | Drogone | 333/239 |
| 4,459,568 | 7/1984 | Landt | 333/116 |
| 4,465,984 | 8/1984 | McDowell | 333/161 X |
| 4,488,125 | 12/1984 | Gentry et al. | 333/1 |

FOREIGN PATENT DOCUMENTS

| | | | |
|---|---|---|---|
| 0009348 | 1/1977 | Japan | 333/33 |
| 0085902 | 7/1981 | Japan | 333/239 |
| 0184301 | 11/1982 | Japan | 333/222 |

OTHER PUBLICATIONS

Collenberger et al., "Method for Fabricating Precision Waveguide Sections", *NBS Technical Note 536;* pp. 10–13, Jun. 1970.

Ragan, George L., *Microwave Transmission Circuits,* McGraw Hill Book Company, N.Y., N.Y., 1948, pp. 349,347–348.

Chalman et al., "Multiple Functions of Blind Copper Vias in Polyimide Multilayer Structures", 4th Annul. Int∝l Electronics Packaging Conf., Oct. 29–31, 1984, Baltimore, Md.

*Primary Examiner*—Eugene R. LaRoche
*Assistant Examiner*—Benny T. Lee
*Attorney, Agent, or Firm*—Peter C. Van Der Sluys; Robert A. Hays

[57] ABSTRACT

A substrate for mounting electronic devices is provided with a capacitive coupler as an interconnecting means. The coupler comprises two partially co-extensive conductors surrounded by a shield. The substrate is made from a plurality of superimposed layers, each layer consisting of a dielectric, or a conductive material, or strips of conductive material separated by the dielectric to form a preselected profile.

7 Claims, 20 Drawing Figures

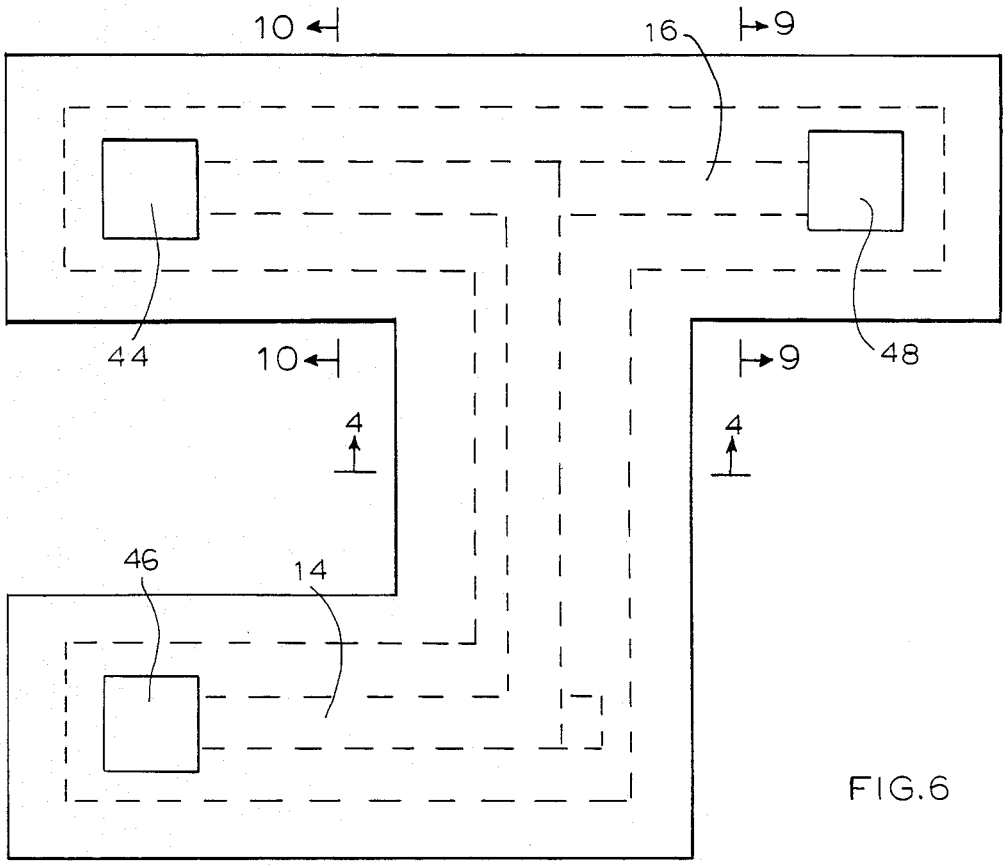
FIG.6
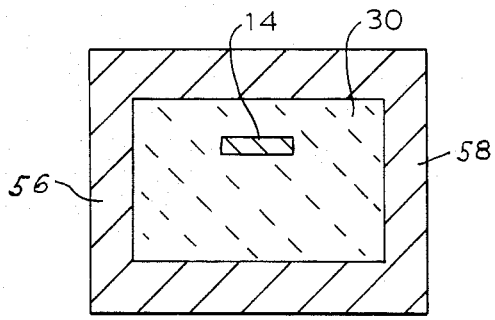
FIG.10
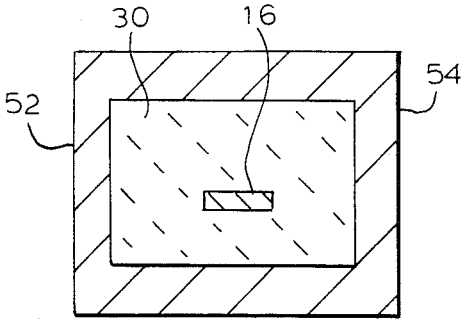
FIG.11
FIG.9
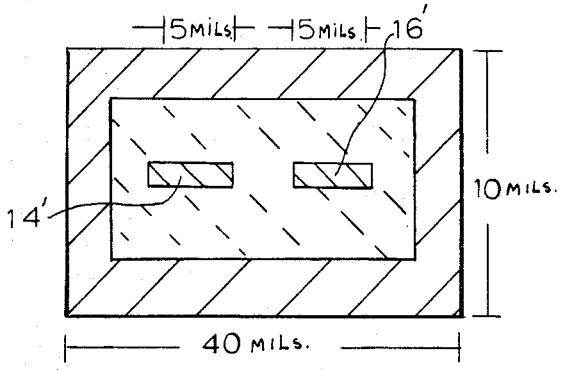

COAXIAL SHIELDED DIRECTIONAL MICROWAVE COUPLER

BACKGROUND OF THE INVENTION

1. Field of Invention

This invention pertains to of a microwave coupler and more particularly to a coupler embedded in a substrate of a printed circuit board and a method for constructing the same.

2. Description of the Prior Art

Signals between various electronic devices are typically exchanged by use of capacitive couplers, comprising discrete capacitors. At high frequencies the capacitors may be only two partially coextensive wires. However these couplers should be shielded to eliminate noise or extraneous signals. It was found that if the electronic devices are mounted on a printed circuit board it is difficult to provide a properly shielded capacitive coupling for interconnecting these devices. Furthermore the coupling may occupy precious space on the board.

OBJECTIVES AND SUMMARY OF THE INVENTION

A primary objective of the present invention is to provide a coupler for interconnecting various electronic devices imbedded in the substrate of a printed circuit board supporting said electronic devices.

Another objective is to provide a coupler which is fully shielded to eliminate noise.

A further objective is to provide a coupler which may be formed simultaneously with other elements imbedded in the substrate.

Other objective and advantages shall become apparent from the following description of the invention. In accordance with this invention, a coupler comprises two partially co-extensive conductors imbedded in a substrate of a printed circuit board provided for mounting electronic devices. The conductors are completely shielded by a shield formed around and coextensive with the conductors. Preferably the substrate is formed by overlapping a plurality of layers, each layer consisting of conductive strips and/or a dielectric material shaped to form the required profile.

BRIEF DESCRIPTION OF THE DRAWINGS

FIG. 6 shows a plan view of the shielded coupling constructed according to this invention;

FIGS. 9 and 10 show sectional views taken along lines 9—9 and 10—10 respectively in FIG. 6; and FIG. 11 shows an alternate embodiment of the invention, with side coupled conductor lines instead of multilayer coupled lines.

DETAILED DESCRIPTION OF THE INVENTION

Figure 1:
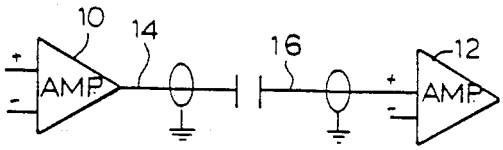
FIG.1 PRIOR ART
FIG. 1 shows a schematic of a first electronic device sending microwaves to a second electronic device through a signal coupler.
Figure 2:
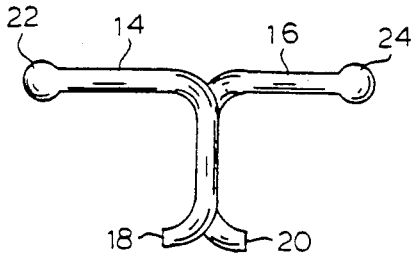
FIG. 2 PRIOR ART
FIG. 2 shows a top view of the physical layout of the two conductors forming the coupling.

Typically two microwave electronic circuits such as amplifiers 10 and 12 in FIG. 1 may be capacitively coupled through two conductors such as 14 and 16. Both conductors are normally shielded to eliminate interference from other similar devices and noise. Physically, the conductors are coupled by placing a portion of each conductor in a spaced parallel relationship as shown in FIG. 2. The free ends 18 and 20 of the conductors may be left open or may be extended to other devices. The other ends 22, 24 are respectively connected to the output and input ports of devices 10 and 12.

Figure 4:
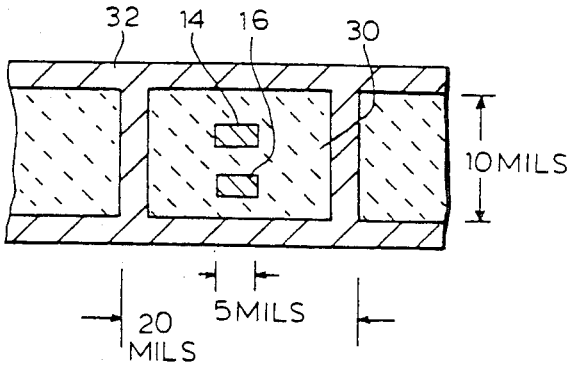
FIG. 4 shows a cross-sectional view of a shielded coupling constructed according to this invention.

It has been previously proposed that the conductors be placed so that a portion one conductor overlaps a portion of the second conductor, the overlapping portions being disposed between two parallel shielding plates 26 and 28. Preferably a low dielectric constant material 30 such as polyimide is also disposed between the plates as shown. However it was found that the two plates 26, 28 do not provide sufficient shielding to the coupled conductors. The present invention provides a microwave coupling in which as shown in FIG. 4, conductors 14, 16 are completely surrounded by a shield 32.

Typically microwave devices 10, 12 are supported by and mounted on a printed circuit board. The various interconnections between these devices may comprise either actual wires bonded to the devices or conductive strips applied to the printed circuit boards by photomasking or other well known techniques. However it is quite difficult to provide shielded conductors on a printed circuit board.

In the copending commonly assigned application Ser. No. 671,276, filed on even date herewith and entitled "MICRO-COAXIAL SUBSTRATE". In that application a substrate for a printed circuit board is disclosed having one or more imbedded conductors, each conductor being individually shielded. The techniques disclosed therein can also be used to generate the shielded coaxial coupling shown in FIG. 4 as shall be described below.

Figure 5A:
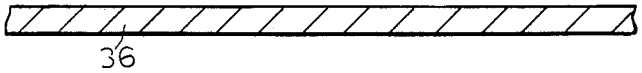
FIG. 5*a*–5*j* shows a method of constructing the coupling of FIG. 4.
Figure 5B:
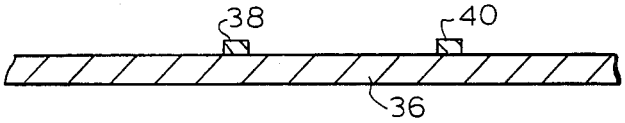
Figure 5C:
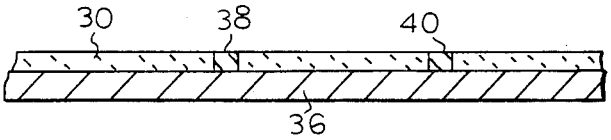
Figure 5D:
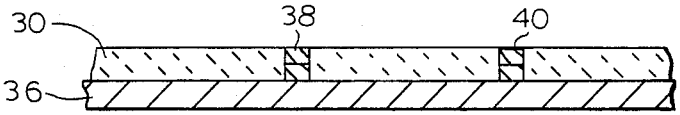
Figure 5E:
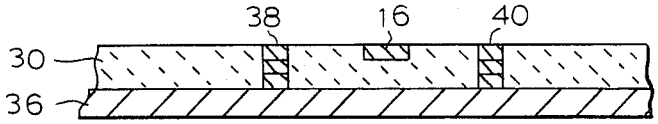
Figure 5F:
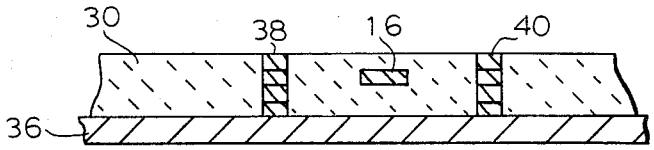
Figure 5G:
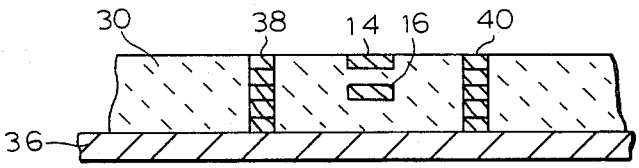
Figure 5H:
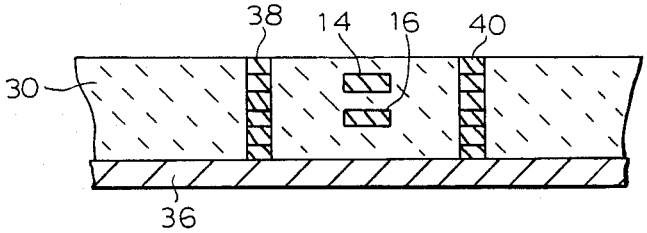
Figure 5I:
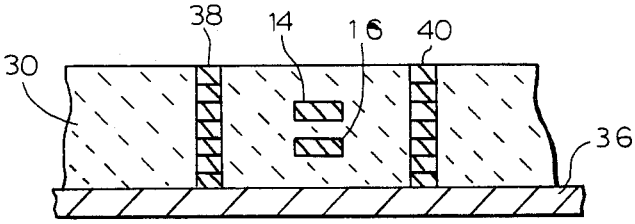
Figure 5J:
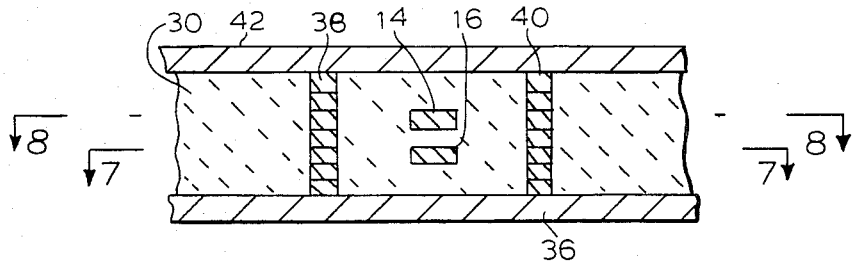

The substrate is constructed by overlapping several layers. The first layer 36 comprises a conductive material which makes up a first ground plane (See FIG. 5*a*). Relatively narrow conductive strips such as 38 and 40 are then applied to layer 36 by photomasking or other methods, as in FIG. 5*b*. The second layer is completed by applying a dielectric material 30 (FIG. 5*c*) such as polyimide to the portion of the layer 36 not covered by the conductive strips. The steps of FIGS. 5*b* and 5*c* are repeated to generate a third layer shown in FIG. 5*d*. The fourth layer is identical to the second and third layer except for a conductive strip corresponding to conductor 16 disposed between strips 38 an 40 as shown in FIG. 5*e*. The layer of FIG. 5*f* is identical to the layers of FIGS. 5*c* and 5*d*. In the layer of FIG. 5*g* a conductive strip corresponding to conductor 14 is disposed above conductor 16 and two more layers of conductive shield are applied above 38 and 40 respectively. Two more layers are applied as shown in FIGS. 5*h* and 5*i* after which the final conductive layer 42 is applied to form a second ground plane as shown in FIG. 5*j*. Thus the conductive layers 36 and 42 and strips 38 and 40 cooperate to form a continuous shield arranged and constructed to surround conductors 14, 16. Layers 42 and 36 form the top and bottom of the shielded while strips 38 and 40 form its sidewalls. Obviously the height of the shield may be changed by increasing or decreasing the number of layers as described. Furthermore one or more layers of a dielectric and/or conductive materials may be added to the substrate of FIG. 5*j* to form a printed circuit board used for mounting electronic devices. It should be understood that in addition to the coupling shown in the accompanying figures, the substrate may have imbedded therein various other elements such as shielded coaxial conductors, which are preferably formed simultaneously with the coupler, as required, by photomasking techniques.

Figure 7:
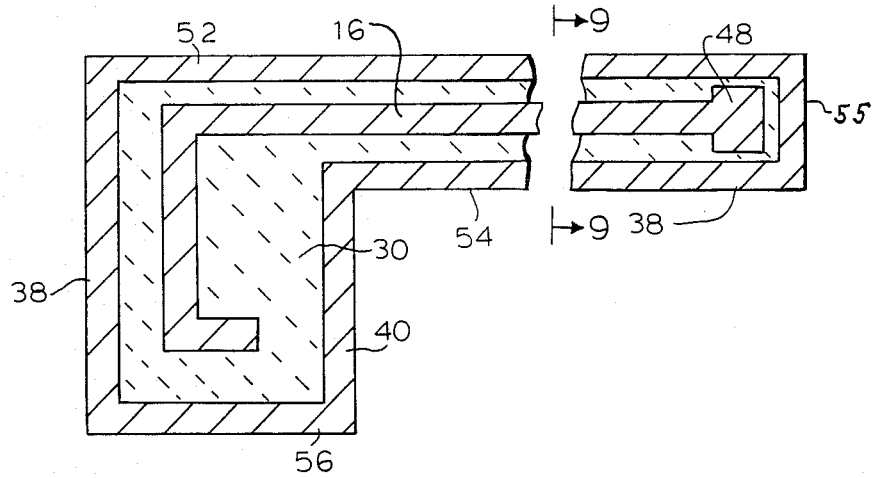
FIGS. 7 and 8 shows sectional view taken along lines 7—7 and 8—8 respectively in FIG. 5.

A top view of the shielded coupler is shown in FIG. 6, with conductor 14 being superimposed on conductor 16. Conductor 14 may be provided with two terminal pads 44, 46 at its extremities as shown for connection to some electronic devices such as amplifier 10. Conductor 16 may be provided with either one terminal pad 48 as shown in FIG. 6 or more than one terminal pad. FIG. 7 shows a top view of the fourth layer deposited during the step illustrated in FIG. 5*e*. It is clear from this figure that the conductor is continuously shielded by sidewalls 38, 40, sidewall extension 52, 54 and end walls 56 and 55. As can be seen in FIG. 5*j*, the conductor 16 is also shielded by top and bottom layers 42 and 36.

Figure 3:
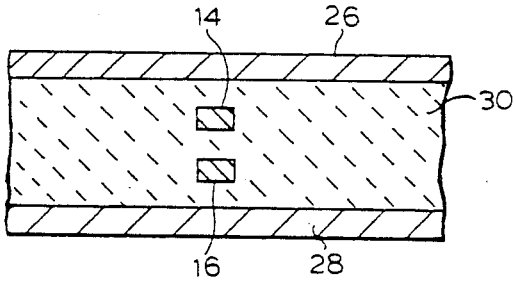
FIG.3 PRIOR ART
FIG. 3 shows a cross-sectional view of a prior art coupling.
Figure 8:
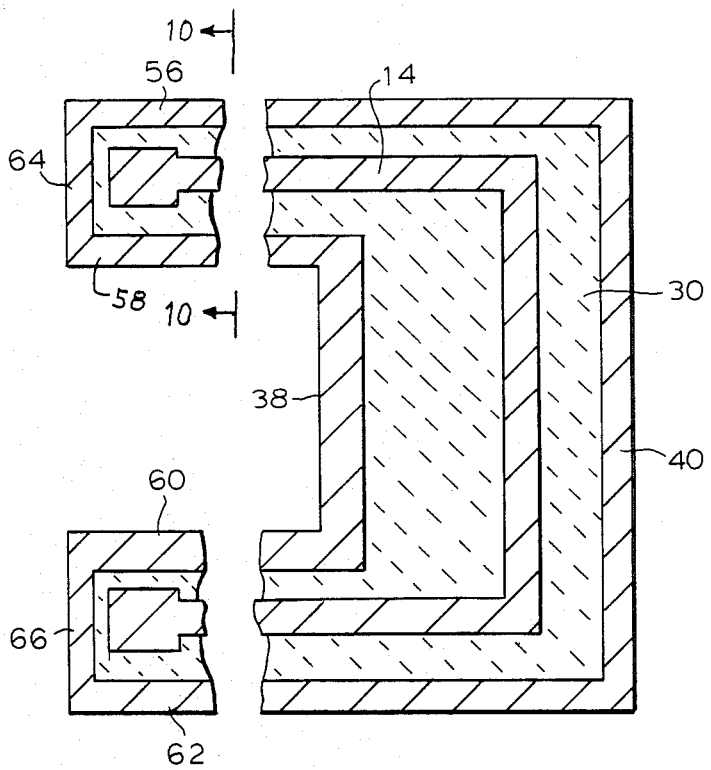

Similarly, FIG. 8 shows a top view of the sixth layer of FIG. 5*g*. As shown in FIGS. 5*j*, 8 and 10, the conductor 14 is shielded by sidewalls 38, 40, sidewall extension 56, 58, 60, 62, end walls 64 and 66 and top and bottom layers 42 and 36. Thus both conductors are provided with a complete coextensive shield. The typical dimensions for a coupler are shown in FIG. 4, it being understood that couplers, of other dimensions could be made using the principles described above. It was found that the coupler constructed in accordance with the above description function as well as means of interconnecting several cascaded stages of a very high frequency amplifier networks. In particular a noticeable improvement was found in the overall performance of the system when compared to the prior art coupler of FIG. 3.

While in the above description the two conductors 14, 16 are shown as being disposed in an overlapping relationship to produce the required capacitive coupling therebetween, obviously other configurations are also possible. For example in FIG. 11, conductors 14', 16' are extending side-by-side. Other modifications could be made to the invention by one skilled in the art without departing from the scope of the invention as defined in the appended claims.

We claim:

1. A method of forming a substrate for supporting electronic components and having a microwave coupler formed therein, comprising the steps of:

providing a first layer of conductive material;

sequentially forming a plurality of pairs of spaced conductive strips in a plurality of layers overlaying said first layer, each strip of each pair of conductive strips being in electrical contact with the first conductive layer and with a corresponding strip of each other pair, corresponding strips of each pair overlaying each other to form a pair of spaced walls having a channel therebetween;

providing dielectric material in portions of each of said plurality of layers not occupied by conductive strips;

forming a second conductive layer on the plurality of layers, whereby the first and second layers and the plurality of pairs of conductive strips define a shielded space in said channel; and forming two spaced conductive strips in one or more of said plurality of layers and within said shielded space, each of said spaced conductive strips being spaced from said first and second layers, being spaced from the pairs of spaced conductive strips, and being formed with a coupling portion, said coupling portions being spaced a predetermined amount to provide a desired coupling for said microwave coupler.

2. A method of forming a substrate as described in claim 1, additionally comprising the steps of:

forming in said plurality of layers conductive portions in electrical contact with said two spaced conductive strips to form terminal pads for said microwave coupler.

3. A method as described in claim 2, wherein forming said terminal pads comprises providing a plurality of stacked conductive portions formed in adjacent layers including, one of said first and second conductive layers, and extending said terminal pad through an opening formed in said one of the first and second conductive layers.

4. A method as described in claim 1, additionally comprising the step of forming conductive portions in said plurality of layers for providing an end wall for the shielded channel.

5. A method as described in claim 1 wherein forming two-spaced conductive strips comprises forming said two-spaced conductive strips in the same layer.

6. A method as described in claim 1 wherein the step of forming two-spaced conductive strips comprises forming two-spaced conductive strips in separate layers.

7. A method as described in claim 1 wherein the step of forming two-spaced conductive strips comprises the steps of forming said two-spaced conductive strips in different spaced layers with one conductive strip overlying the other.

* * * * *